US005262292A

United States Patent [19]

Krishnamurthy et al.

[11] Patent Number: 5,262,292

[45] Date of Patent: Nov. 16, 1993

[54] PHOTOGRAPHIC ELEMENTS CONTAINING PYRAZOLONE COUPLERS AND PROCESS

[75] Inventors: Sundaram Krishnamurthy, Rochester; Thomas A. Rosiek, Honeoye Falls; Vincent J. Flow, Kendall; David S. Bailey, Rochester; David J. Giacherio, Rochester; John L. Pawlak, Rochester; Stephen P. Singer, Spencerport, all of N.Y.

[73] Assignee: Eastman Kodak Company, Rochester, N.Y.

[21] Appl. No.: 872,577

[22] Filed: Apr. 23, 1992

Related U.S. Application Data

[63] Continuation-in-part of Ser. No. 689,436, Apr. 23, 1991.

[51] Int. Cl.[5] ..... G03C 7/384

[52] U.S. Cl. ..... 430/555; 430/387

[58] Field of Search ..... 430/555, 543, 387

[56] References Cited

U.S. PATENT DOCUMENTS

| | | | |
|---|---|---|---|
| 3,227,555 | 1/1966 | Van Norman | 430/628 |
| 3,519,429 | 7/1992 | Lestina | 96/100 |
| 4,413,054 | 11/1983 | Mitsui et al. | 430/555 |
| 4,853,319 | 8/1989 | Krishnamurthy et al. | 430/555 |
| 4,876,182 | 10/1989 | Buckland et al. | 430/555 |
| 4,929,540 | 5/1990 | Furutachin et al. | 435/555 |
| 4,990,276 | 2/1991 | Bishop et al. | 252/62.54 |
| 5,096,805 | 3/1992 | Aoki et al. | 430/555 |

FOREIGN PATENT DOCUMENTS 60-57839 4/1985 Japan .

*Primary Examiner*—Lee C. Wright
*Attorney, Agent, or Firm*—Arthur E. Kluegel

[57] ABSTRACT

Pyrazolone magenta dye-forming couplers having a particular arylthio coupling-off group enhance the photographic properties and improve the manufacturing and handling characteristics of materials and processes employing such couplers. The coupler contains an N-phenyl group, a 3-anilino group and a 4-(arylthio) coupling off group containing a particular aryloxymethylacylamino group as an ortho substituent. A broad range of improvements are realized including stability, reactivity, hue, and dye density in addition to simplified and safer manufacture.

The coupler may be represented by the following formula where the substituents and variables are as defined in the specification:

15 Claims, No Drawings

PHOTOGRAPHIC ELEMENTS CONTAINING PYRAZOLONE COUPLERS AND PROCESS

CROSS REFERENCE FOR RELATED APPLICATION

This application is a continuation-in-part of U.S. Ser. No. 07/689,436 filed Apr. 23, 1991.

BACKGROUND OF INVENTION

This invention relates to pyrazolone magenta dye-forming couplers having a particular aryl thio coupling-off group that enables improved photographic properties, improved manufacturing and handling characteristics and to photographic materials and processes employing such couplers.

There are numerous properties and characteristics that must be controlled in the successful design of a photographic element. Among these are light stability, dark stability, developer retention, dye density, leuco-dye formation, printability, minimization of continued coupling and coupling efficiency. Light stability refers to the ability of the element, e.g. a color print, to withstand light exposure without degradation. Dark stability refers to the ability of the elements to withstand dark storage, e.g. in a photo album. Developer retention refers to the ability of the conventional processing bath to effectively remove any remaining unreacted developer from within the film structure so that such developer will not over a period of time continue to react with the coupler and form additional undesired dye density. Sufficient dye density is essential to obtaining the desired degree of color contrast and intensity. Leuco-dye is an intermediate stage of dye formation all of which must have been converted to dye by the end of the development process (e.g. 90 seconds for negative-positive or 3 minutes 15 seconds for color negative) otherwise the dye density and corresponding color balance will be unstable. When a coupler tends to form a stable leuco-dye, a layer of finely divided silver halide ("Lippman Silver") is often employed to oxidize the leuco-dye to its final form. Printability refers to the compatibility of the light absorbance curve as a function of wavelength as compared to the curve employed as a printing standard in high speed printing. Continued coupling refers to the extent to which the coupler will undesirably react with oxidized developer formed in the bleach bath resulting in stain, and coupling efficiency refers to the quantity of a coupler necessary to achieve a given dye density.

Due to the complexity of the organic couplers employed in modern photography, it has become exceedingly difficult to discover materials which satisfy these diverse needs. So-called four equivalent 3-anilino pyrazolone couplers have provided magenta dye images having useful properties. Examples of such compounds are described in, for example, U.S. Pat. Nos. 3,907,571, 3,928,044, 3,935,015, 4,199,361 and 3,519,429. An example of one such pyrazolone coupler, described in, for example, U.S. Pat. No. 3,519,429 is herein designated as comparison coupler C-1 and is represented by the formula:

C-1

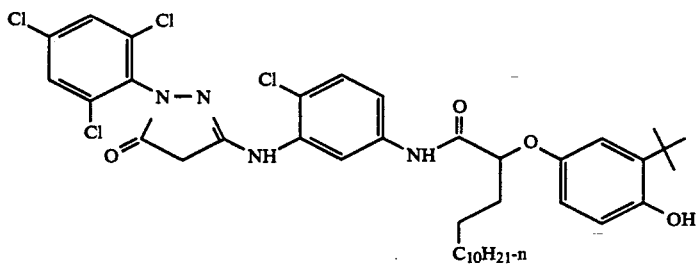

This prior art coupler has a number of disadvantages. Since C-1 is a four-equivalent coupler, more silver halide and coupler must be used to obtain adequate dye yield when compared to two-equivalent couplers. This increases the costs associated with this type of coupler. Also, the dye light stability is less than desired and the dye dark stability is quite poor. Further, the coupler itself causes substantial yellow stain in areas of minimum density, especially when kept under humid conditions.

Examples of so-called 2-equivalent 3-anilino 4-(arylthio) pyrazolones are described in, for example, U.S. Pat. No. 4,413,054, Japanese published patent application 60/057839, U.S. Pat. Nos. 4,351,897, 4,900,657, and 4,876,182. An example of such a pyrazolone coupler described in, for example, U.S. Pat. No. 4,413,054 is designated herein as comparison coupler C-2 and is represented by the formula:

C-2

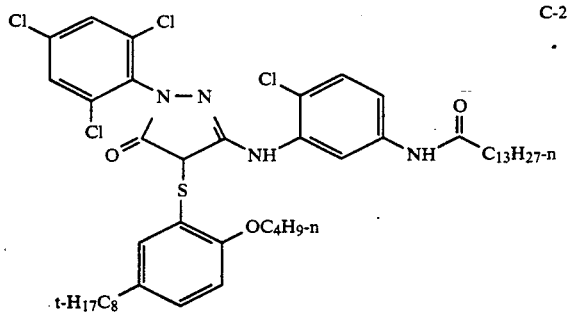

The presence of an alkoxy group in the ortho position on the phenylthio coupling-off group of coupler C-2 has provided advantageous properties. However, this type coupler has not been entirely satisfactory due to formation of undesired stain in a color photographic silver halide element upon exposure and processing and does not provide desired printability characteristics for rapid machine processing. The coupler C-2 does not achieve full dye density, especially when the exposed color photographic element is machine processed without the presence of Lippman fine grain silver halide being present in the photographic element. It has been desirable to reduce or avoid the need for added Lippman fine grain silver halide without diminishing dye density in the processed color photographic silver halide element. The prior art coupler C-2 does not answer this problem.

Another example of a pyrazolone coupler known to the art is described in U.S. Pat. No. 4,853,319 is designated herein as comparison coupler C-3 and is represented by the formula:

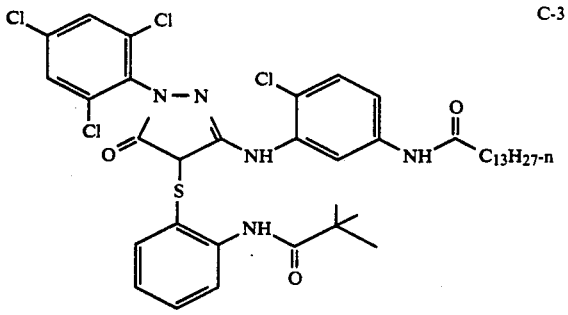

C-3

The presence of an acylamine group in the ortho position on the phenylthio coupling-off group of coupler C-3 has provided advantageous properties. This coupler does not require Lippman fine grain silver halide in order to obtain adequate dye density upon rapid machine processing. However, this type of coupler does suffer from unwanted gains in both green and blue density in unexposed areas upon standing in the dark. Another problem with couplers of this type is their propensity to retain developer after processing, which can lead to an increase in unwanted density or stain upon standing. Further, although the dye light stability for this class of couplers is good, additional improvement in dye light stability is still needed.

Another example of a pyrazolone coupler known to the art is described in U.S. Pat. No. 4,853,319 is designated herein as comparison coupler C-4 and is represented by the formula:

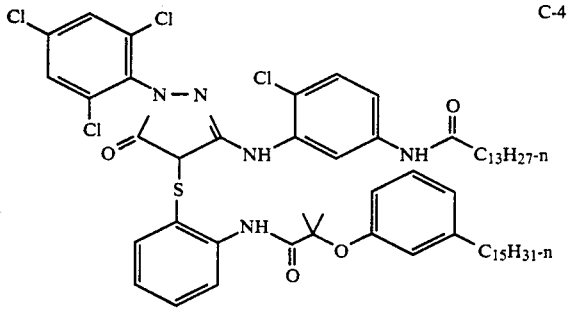

C-4

The synthesis of this type of coupler is problematic. The ballast portion of the coupling off group is made through the reaction of the ballasted phenol, sodium hydroxide, acetone and chloroform and involves a highly reactive carbene intermediate. The explosion hazard associated with this material is unacceptable from a safety standpoint. Therefore, this route is not amenable to synthesis on a production scale. Also, only symmetrical dimethyl-substituted acylamine ballasted coupling off groups can be obtained. Reactants other than acetone do not work satisfactorily in this reaction. An additional limitation is that the coupling reaction works best for phenols with either no ortho substituent or, at most, a small ortho substituent. This further limits the scope of the reaction. In a photographic element, the light stability of this type of coupler is not as good as is desired, and the dye from this coupler has high unwanted blue absorbance and therefore inaccurate color reproduction. The symmetry of the molecule leads to dye aggregation and solubility problems.

Another example of a pyrazolone coupler known to the art is described in Japanese published application 60-057839 is designated herein as comparison coupler C-5 and is represented by the formula:

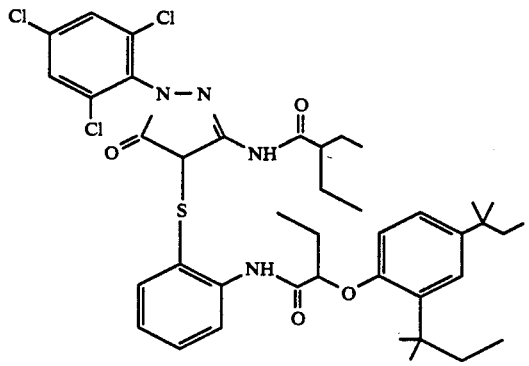

C-5

This type of coupler does not produce sufficient dye density, especially in a rapid access format, to be useful as a coupler in a photographic element. In addition this coupler exhibits poor hue and unwanted absorbance characteristic of the 3-acylamino type pyrazolone couplers.

Other examples of pyrazolone couplers known to the art are described in U.S. Pat. Nos. 4,853,319 and 4,929,540 are designated herein as comparison C-6 and C-7 and are represented by the formulas:

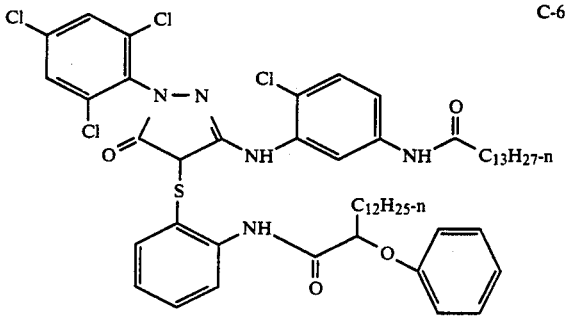

C-6

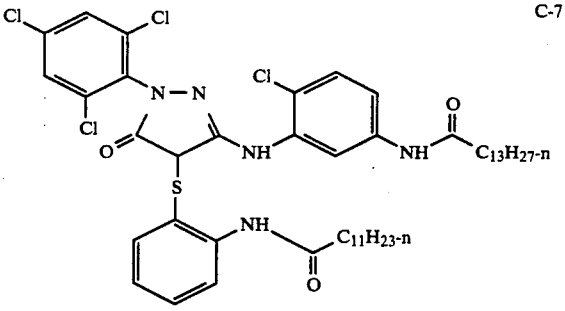

C-7

These couplers and comparison couplers C-2, C-3 and C-4 all form dyes which undesirably aggregate which is of primary concern in color negative processing. The result of this aggregation is an unsymmetrical bulging of the dye hue curve on the hypsochromic side (shorter wavelength). In negative-positive systems, it is important for good color reproduction to minimize the unwanted blue density in the green layer, expecially at 440 nm and 480 nm (where printers and color paper measure blue density, respectively), and to maximize green density at 550 nm (where printers and color paper measure green density). Comparison couplers C-2, C-3, C-4, C-6 and C-7 all show an undesirable increase of blue density because of aggregation, and this leads to poor color reproduction of the color print. The coupler of the invention, on the other hand, does not exhibit this undesired blue density to such an extent and is far more satisfactory from the printability standpoint.

One further example of a pyrazolone coupler is shown in U.S. Pat. No. 4,876,182 and has the formula:

C-8

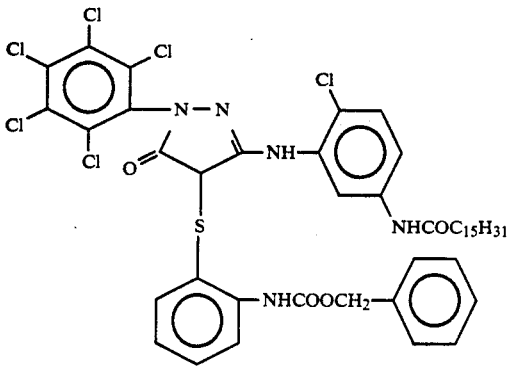

This compound has provided good results but has exhibited a less than desired coupler efficiency.

It has been desired to provide a new pyrazolone coupler having a coupling-off group in a color photographic silver halide element and process which is capable of forming a magenta dye image of good stability, with high dye yield and low unwanted blue absorption as well as high activity and reduced incidence of continued coupling. Additionally, it is desired to provide such a coupler which displays excellent thermal stability in areas of no light exposure and which has no tendency to retain color developer after photographic processing. Further, it has been desired to provide a new pyrazolone coupler which provides all of the above attributes and can be produced in good yield by a convenient safe procedure that is amenable to large scale production.

SUMMARY OF THE INVENTION

It has been found that these objectives are achieved in a color photographic element comprising a support bearing at least one silver halide emulsion layer having associated therewith a 5-pyrazolone photographic coupler represented by the following formula:

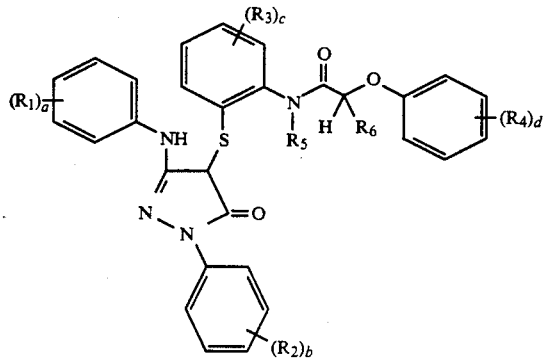

wherein a and b are individually 0 to 5, c is 0 to 4, and d is 1 to 5;

each $R_1$, $R_2$, $R_3$ and $R_4$ is individually selected from halogen, such as chlorine, bromine or fluorine; nitro; cyano; carboxy; alkyl or aryl, such as those containing 1 to 30 carbon atoms; alkoxy, such as alkoxy containing 1 to 30 carbon atoms; aryloxy, acylamino; sulfonamido; sulfamoyl; sulfamido; carbamoyl; diacylamino; aryloxycarbonyl; alkoxycarbonyl; alkoxysulfonyl; aryloxysulfonyl; alkylsulfonyl; arylsulfonyl; alkylthio; arylthio; alkoxycarbonylamino; aryloxycarbonylamino; alkylsulfoxyl; arylsulfoxyl; alkylureido; arylureido; and heterocyclic; and acyloxy;

$R_5$ is selected from the group consisting of hydrogen, alkyl, aryl, acyl and heterocyclic group, and $R_6$ is selected from the group consisting of hydrogen, alkyl, aryl, and heterocyclic group;

DETAILED DESCRIPTION OF THE INVENTION

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form but also its form substituted with any substituents which do not negate the advantages of this invention.

Examples of suitable substituents $R_1$, $R_2$, $R_3$ and $R_4$ include halogen, such as chlorine, bromine or fluorine; alkyl or aryl, including straight or branched chain alkyl, such as those containing 1 to 30 carbon atoms, for example methyl, trifluoromethyl, ethyl, t-butyl, and tetradecyl; alkoxy, such as alkoxy containing 1 to 30 carbon atoms, for example methoxy, ethoxy, 2-ethylhexyloxy and tetradecyloxy; aryloxy, such as phenoxy, α-or β-naphthyloxy, and 4-tolyloxy; acylamino, such as acetamido, benzamido, butyramido, tetradecanamido, α-(2,4-di-t-pentylphenoxy)-acetamido, α-(2,4-di-t-pentylphenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5-tetradecylpyrrolin-1-yl, N-methyl-tetradecanamido, and t-butylcarbonamido; sulfonamido, such as methanesulfonamido, benzenesulfonamido, p-toluenesulfonamido, p-dodecylbenzenesulfonamido, N-methyltetradecylsulfonamido, and hexadecanesulfonamido; sulfamoyl, such as N-methylsulfamoyl, N-hexadecylsulfamoyl, N, N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as N-methylsulfamido and N-octadecylsulfamido; carbamoyl, such as N-methylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxphenoxy carbonyl; alkoxycarbonyl, such as alkoxycarbonyl containing 2 to 30 carbon atoms, for example methoxycarbonyl, tetradecyloxycarbonyl, ethoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl; alkanesulfonyl, such as alkanesulfonyl containing 1 to 30 carbon atoms, for example methanesulfonyl, octanesulfonyl, 2-ethylhexanesulfonyl, and hexadecanesulfonyl; arenesulfonyl, such as benzenesulfonyl, 4-nonylbenzenesulfonyl, and p-toluenesulfonyl; alkylthio, such as alkylthio containing 1 to 22 carbon atoms, for example ethylthio, octylthio, benzylthio, tetradecylthio, and 2-(2,4-di-t-pentylphenoxy)ethylthio; arylthio, such as phenylthio and p-tolylthio; alkoxycarbonylamino, such as ethoxycarbonylamino, benzyloxycarbonylamino, and hexadecyloxycarbonylamino; alkylureido, such as N-methylureido, N,N-dimethylureido, N-methyl-N-dodecylureido, N-hexadecylureido, N,N-dioctadecylureido, and N,N-dioctyl-N'-ethyl-ureido; acyloxy, such as acetyloxy, benzoyloxy, octadecanoyloxy, p-dodecanamidobenzoyloxy, and cyclohexanecarbonyloxy; nitro; cyano; carboxy and heterocyclic where preferably the foregoing organic substituents contain not more than 30 and preferably not more than 20 carbon atoms.

The term "coupler" herein refers to the entire compound, including the coupler moiety and the coupling-off group. The term "coupler moiety" or "COUP" refers to that portion of the compound other than the coupling-off group and the term "COG" refers to the coupling-off group.

COUP can be any 3-anilino-5-pyrazolone coupler moiety known or used in the photographic art to form a color reaction product particularly a magenta dye, with oxidized color developing agent. Examples of useful pyrazolone coupler moieties are described in, for example, U.S. Pat. Nos. 4,443,536; 4,853,319; 4,199,361; 4,351,897; 4,385,111; Japanese Published Patent Application 60/170854; U.S. Pat. Nos. 3,419,391; 3,311,476; 3,519,429; 3,152,896; 2,311,082; and 2,343,703, the disclosures of which are incorporated herein by reference. Syntheses of COUP moieties as described in Item 16736 in Research Disclosure, March 1978; UK Patent 1,530,272; U.S. Pat. No. 3,907,571 and U.S. Pat. No. 3,928,044. The coupling-off group, if any, on the pyrazolone coupler moiety described in these patents or patent applications can be replaced by a coupling-off group according to the invention. The pyrazolone coupler according to the invention can be in a photographic element in combination with any other couplers known or used in the photographic art, such as in combination with at least one of the pyrazolone couplers described in these patents or published patent applications.

$R_5$ and $R_6$ or $R_5$ and $R_3$ optionally join to form an alicyclic or heterocyclic ring.

The pyrazolone coupler may be a monomeric, dimeric, trimeric, oligomeric or polymeric coupler. Also, the coupler may contain alkyl linking groups between the sulfur and the acylamino group of the coupling-off group.

In the preferred embodiment of the invention $R_6$ is other than hydrogen so that the carbon to which $R_6$ is attached is a chiralic group. This feature imparts additional bulk and steric features to the compound which help to minimize the extent of dye aggregation which can have a negative effect on the dye hue. Illustrative couplers include:

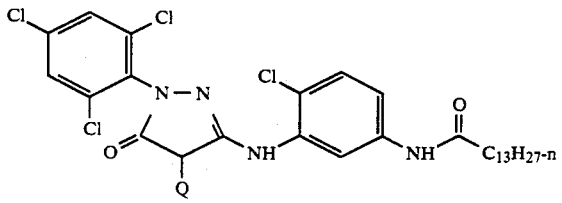

A-1

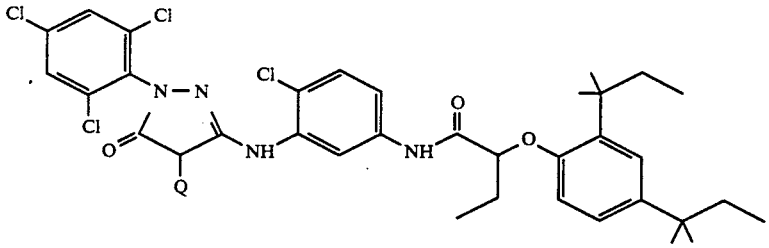

A-2

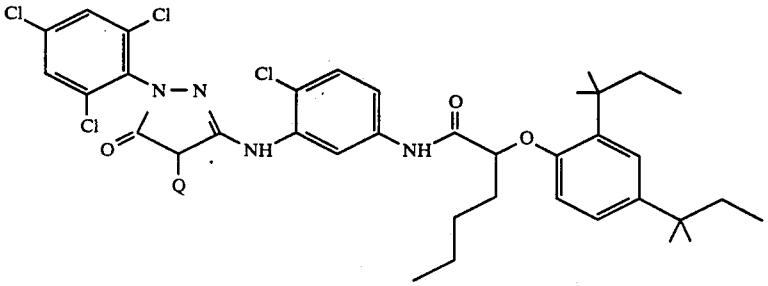

A-3

-continued
A-4
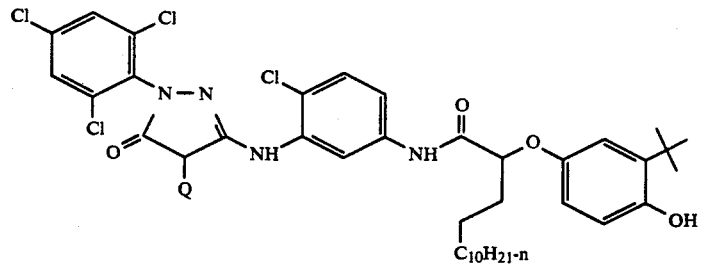
A-5
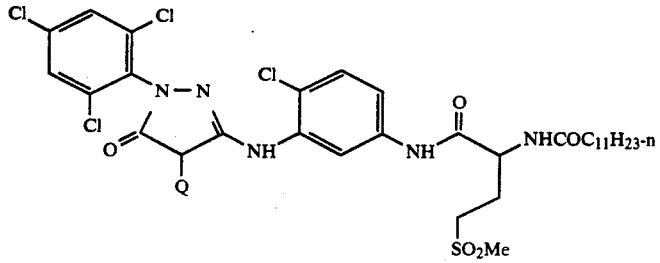
A-6
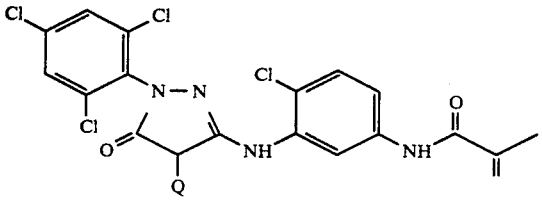
A-7
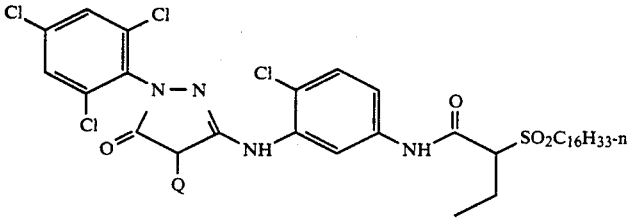
A-8
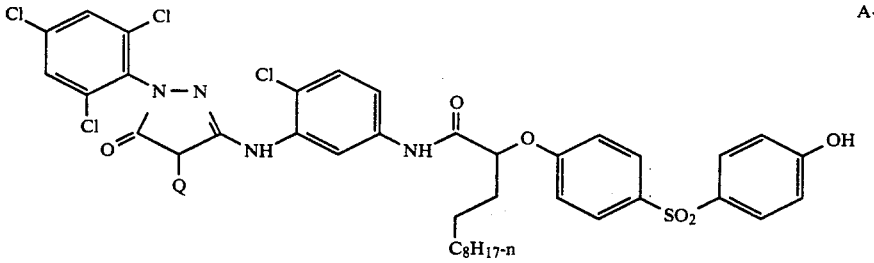
A-9
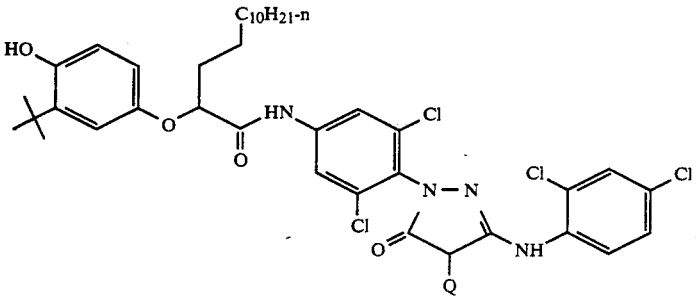

-continued
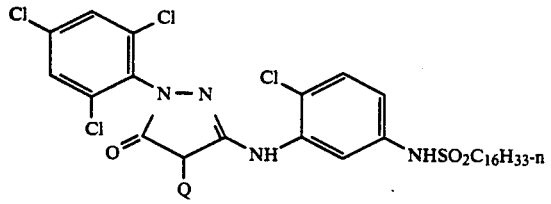
A-10
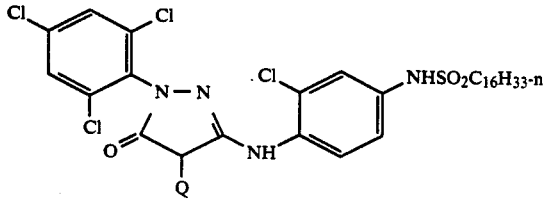
A-11
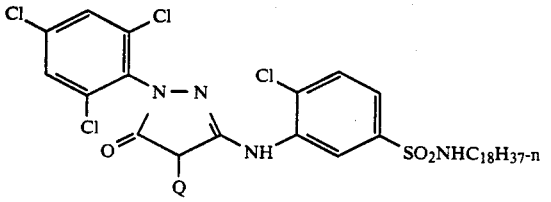
A-12
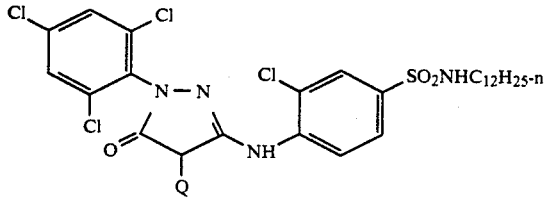
A-13
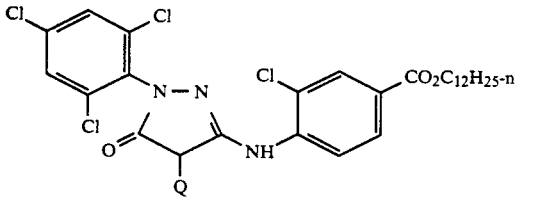
A-14
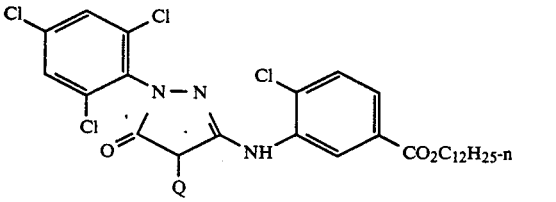
A-15
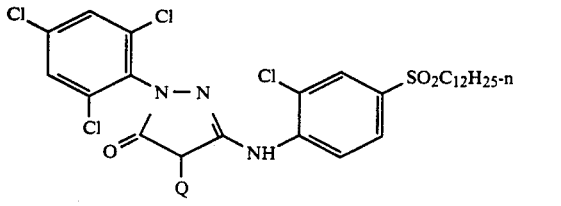
A-16

-continued
A-17
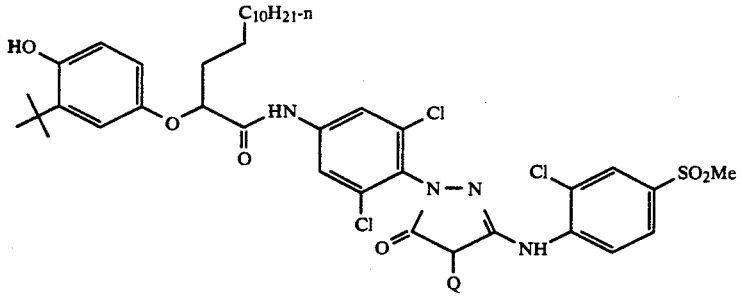
A-18
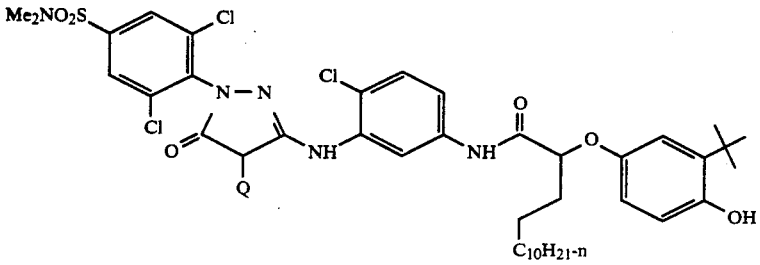
Q herein represents a coupling-off group according to the invention. Illustrative coupling-off groups (Q) are as follows, with the sulfur bond to the 4-carbon of the pyrazolone understood:
Q-1
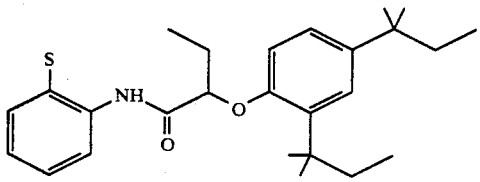
Q-2
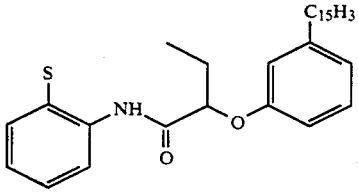
Q-3
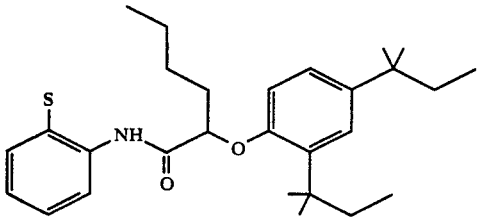
Q-4
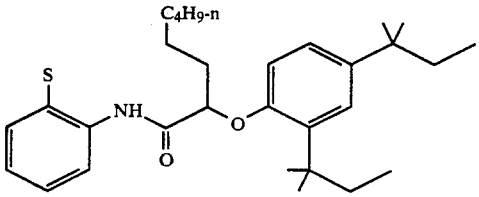
-continued
Q-5
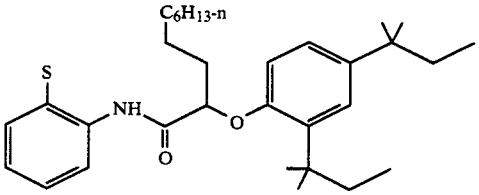
Q-6
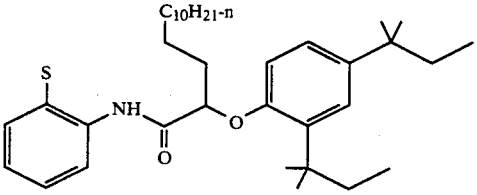
Q-7
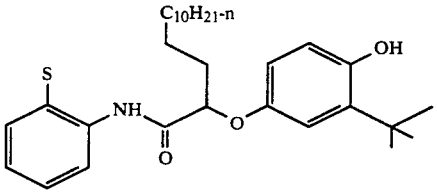
Q-8
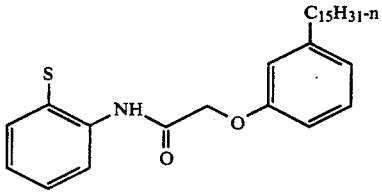
Q-9
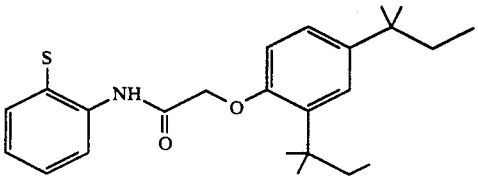

-continued

Q-10

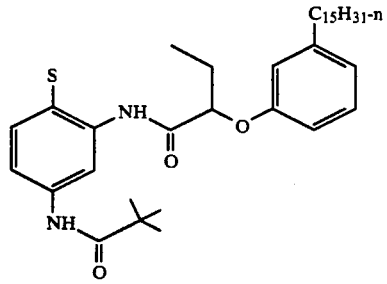

Q-11

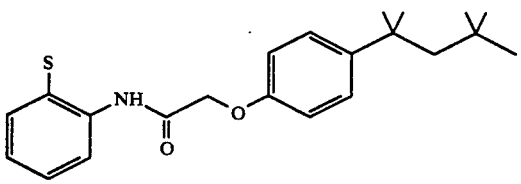

Q-12

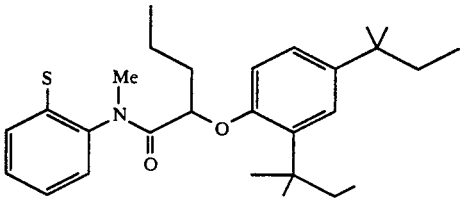

Q-13

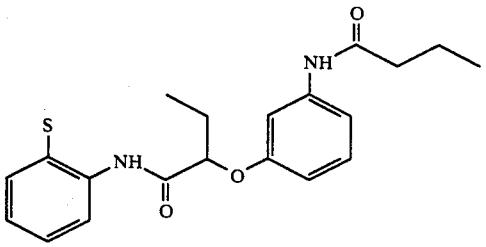

Q-14

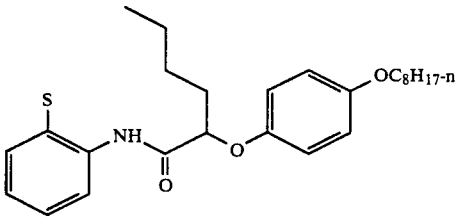

Q-15

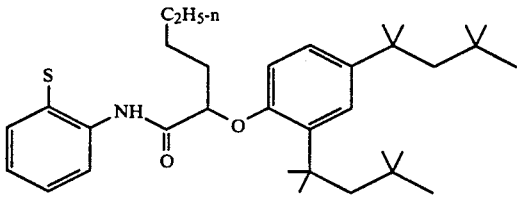

Q-16

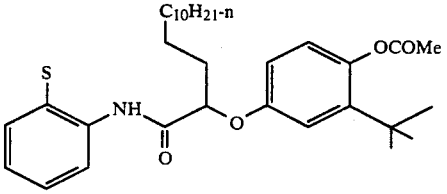

-continued

Q-17

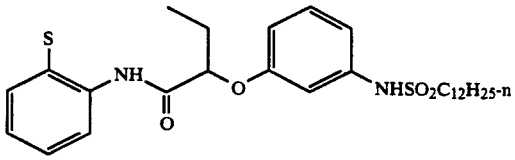

Q-18

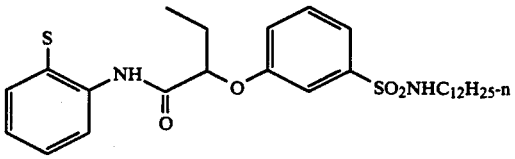

Q-19

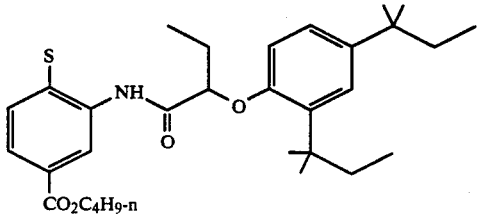

Q-20

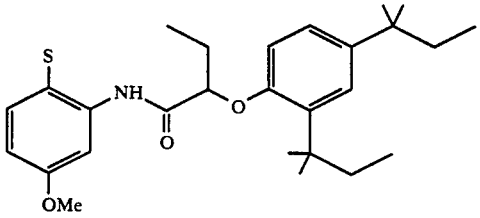

The pyrazolone couplers preferably comprise at least one ballast group. The ballast group can be any ballast known in the photographic art. The ballast is typically one that controls diffusion but does not adversely affect reactivity, stability and other desired properties of the coupler and does not adversely affect the stability, hue and other desired properties of the dye formed from the coupler. Illustrative useful ballast groups are described in the following examples.

Couplers of this invention can be prepared by reacting the parent 4-equivalent coupler containing no coupling-off group with the aryl disulfide of the coupling-off group according to the invention. This is a simple method and does not involve multiple complicated synthesis steps. The reaction is typically carried out in a solvent, such as dimethylformamide or pyridine.

The couplers according to the invention can be prepared by the following illustrative synthetic scheme, where COUP represents the coupler moiety having the coupling-off group attached at its coupling position:

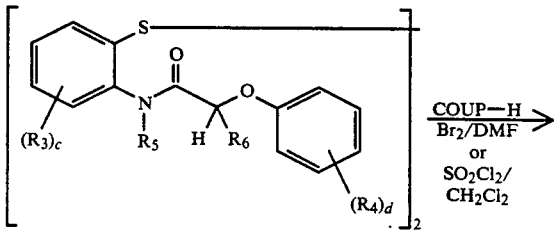

-continued

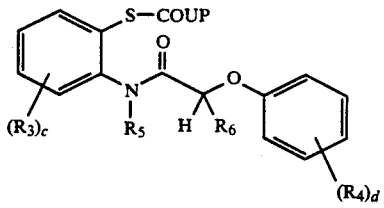

wherein COUP is the coupler moiety and $R_3$ through $R_6$ are as defined.

The following examples illustrate the preparation of couplers of this invention.

SYNTHESIS EXAMPLE A

Synthesis of Coupler M-1

Synthesis of o-Aminophenyl Disulfide

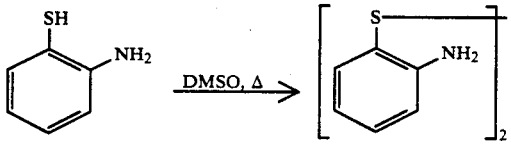

A 1-L flask equipped with a magnetic stirring bar and a reflux condenser was charged with o-aminobenzenethiol (200 g, 1.6 moles) and dimethylsulfoxide (500 mL). The well stirred mixture was gently heated (~50° C.); the reaction was monitored to completion (2.5 hr, TLC, ligroin 950:EtOAc, 2:1). The mixture was poured into crushed ice. The product, o-aminophenyl disulfide was collected as a greenish yellow solid (169 g, 85% yield). This was further purified by recrystallization from hot methanol to furnish pale yellow solid, mp 88°-89° C.; HPLC=99%.

Synthesis of o-(2,4-di-tert-pentylphenoxy)butyramidophenyl Disulfide

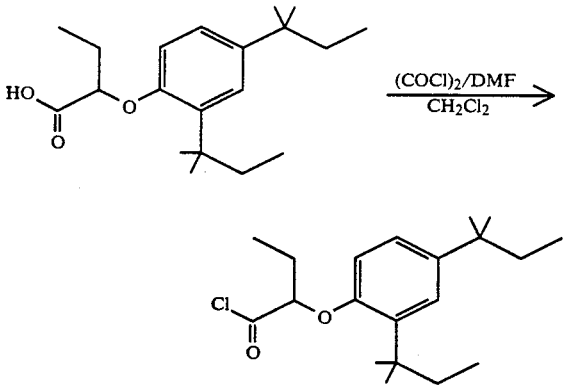

A 1-L round-bottom flask, equipped with a magnetic stirring bar, was charged with 2-(2,4-di-tert-pentylphenoxy)butyric acid (68.8 g, 210 mmol) and 250 mL of dichloromethane. To this well stirred solution of the acid, maintained ca. 25° C. (water-bath), oxalyl chloride (28.5 g, 220 mmol) was added through the dropping funnel. The resulting mixture was cooled (0° C., ice-bath) and N,N-dimethylformamide (DMF, 0.2 mL) was added as the catalyst. The reaction was stirred at 25° C. to completion (monitored by esterification with methanol and TLC analysis in ligroin 950:EtOAc, 2:1). Removal of solvents on a rotary evaporator furnished the desired acid chloride as a pale yellow viscous liquid.

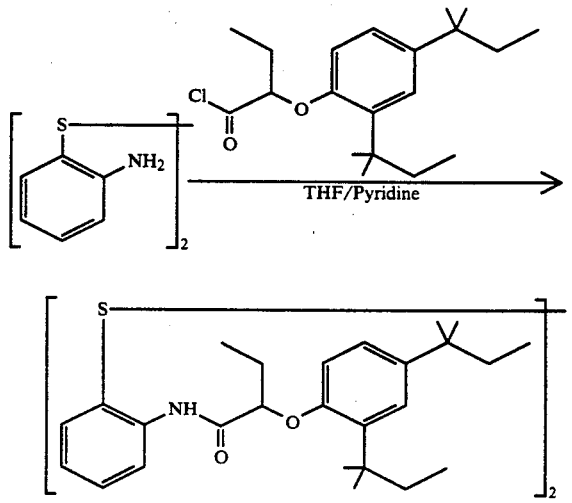

The acid chloride thus synthesized was dissolved in tetrahydrofuran (THF, 100 mL) and added dropwise through a pressure equalized addition funnel to a 1-L flask containing magnetically stirred solution of o-aminophenyl disulfide (24.8 g, 100 mmol) in 200 mL of THF and 75 mL of pyridine. The reaction was monitored to completion by TLC (20 min). The mixture was poured into crushed ice and the precipitate was collected; the crude product o-(2,4-di-tert-pentylphenoxy)-butyramidophenyl disulfide, was further purified by recrystallization from a mixture of acetonitrile and propionitrile to afford 35 g (41% yield) of the desired product. HPLC: 99.1%. Anal Calcd for $C_{52}H_{72}O_4N_2S_2$: C, 73.2; H, 8.5; N, 3.3; S, 7.5. Found: C, 73.2; H, 8.3; N, 2.9; S, 7.0. The $^1H$ NMR spectrum ($CDCl_3$, 300 MHz) was consistent with the structure.

Attachment of o-(2,4-di-tert-pentylphenoxy)butyramidophenylthio Coupling-off group to the pyrazolone coupler

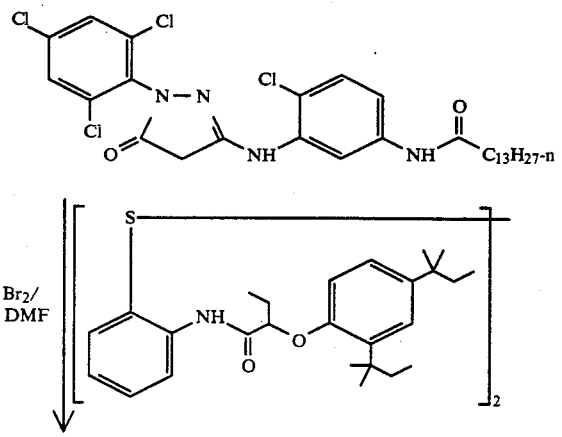

-continued

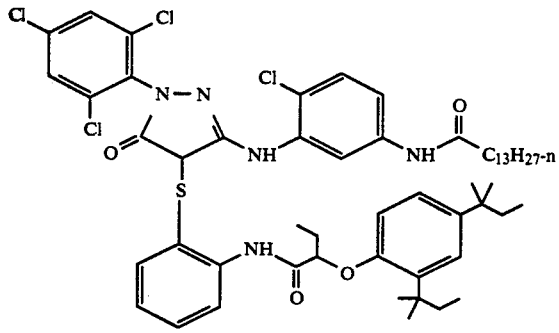

A 500 mL flask epuipped with a magnetic stirring bar and a pressure equalizing addition funnel was charged with o-(2,4-di-tert-pentylphenoxy)butyramidophenyl disulfide (8.6 g, 10.1 mmol), pyrazolone coupler (MW 614, 11.8 g, 19.2 mmol), and DMF (70 mL). To this well-stirred slurry, bromine (1.8 g, 11.1 mmol) dissolved in DMF was added dropwise through an addition funnel. The resulting mixture was carefully heated to ~60° C., and maintained at that temperature; the reaction was followed by TLC to completion (4 hr). The mixture was poured into crushed ice and the resulting product was filtered to afford the desired coupler (18.5 g, 85%). This was further purified by recrystallization from hot propionitrile, mp 201°-203° C.; HPLC: 99.6%; the $^1H$ NMR spectrum was consistent with the structure. Anal Calcd for $C_{55}H_{71}Cl_4N_5O_4S$: C, 63.5; H, 6.9; N, 6.7; Cl, 13.6; S, 3.1.Found: C, 63.8; H, 6.7; N, 6.5; Cl, 13.3; S, 3.2.

SYNTHESIS EXAMPLE B

Synthesis of Coupler M-3

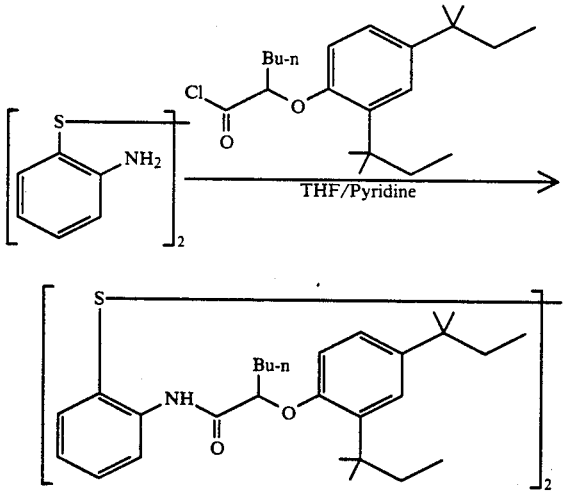

Synthesis of o-(2,4-di-tert-pentylphenoxy)hexanamidophenyl Disulfide

A 250-mL flask was charged with o-aminophenyl disulfide (6.8 g, 27.5 mmol), THF (100 mL), and pyridine (35 mL). The well stirred mixture was immersed in a water bath (~25° C.). A THF solution of 2-(2,4-di-tert-pentylphenoxy)hexanoyl chloride (21.2 g, 58 mmol) was added dropwise through the addition funnel with vigorous stirring. The reaction was monitored to completion by TLC (ligroin 950:EtOAc, 2:1). Usual work-up provided o-(2,4-di-tert-pentylphenoxy)hexanamidophenyl disulfide (24.3 g, 96%) as yellowish brown glass. The $^1H$ NMR spectrum was consistent with the structure.

Attachment of o-(2,4-di-tert-pentylphenoxy)hexanamidophenylthio Coupling-off Group to the Pyrazolone Coupler

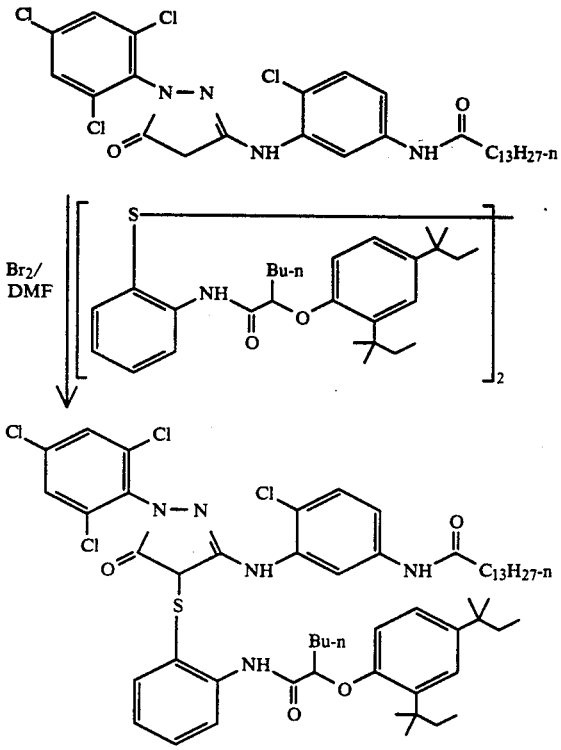

The experimental set-up is the same as in previous experiments. o-(2,4-Di-tert-pentylphenoxy)-hexanamidophenyl disulfide (7.6 g, 8.4 mmol), DMF (60 mL), and the pyrazolone coupler (MW 614.6, 9.25 g, 15 mmol) were placed in the reaction flask and the resulting solution was vigorously stirred at room temperature. Bromine (1.5 g, 9.2 mmol) dissolved in DMF (10 mL) was added slowly through an addition funnel. The addition funnel was replaced with a reflux condenser and the mixture was heated at 60°-70° C. to completion (TLC, ligroin 950:EtOAc, 2:1). The mixture was poured into vigorously stirred crushed ice-water. The precipitate was filtered and dried to afford the desired coupler (13.7 g, 86% yield) as a tan solid, essentially pure. This was recrystallized twice from a 1:1 mixture of hot acetonitrile and propionitrile to furnish a white solid, mp 212°-214° C.; HPLC: 96%. Anal. Calcd. for $C_{57}H_{75}Cl_4N_5O_4S$: C, 64.1; H, 7.1; N, 6.5; Cl, 13.3; S, 3.0. Found: C, 64.0; H, 7.0; N, 6.2; Cl, 13.2; S, 3.4.

The purity of the two-equivalent couplers synthesized was checked by (a) TLC in two or three different solvent systems of different polarity, (b) HPLC, (c) 300 MHz FT-NMR and (d) elemental analyses (C, H, N, Cl, S); some samples were also subjected to mass spectral analysis. As demonstrated in the synthetic examples, the COG portion of the coupler can be easily obtained in good yield by a simple and manufacturable route amenable to large scale production. This contrasts with the hazardous route needed to produce COG's of the type disclosed in U.S. Pat. No. 4,853,319. The compounds of Table I were prepared by this general method.

TABLE I

Summary of Invention Couplers[a,b]

| Coupler | HPLC Purity[c] | | Elemental Analysis C | H | N | Cl | S | mp. °C. | Type | Coupler Composition COUP/Q |
|---|---|---|---|---|---|---|---|---|---|---|
| M-1 | 99.6 | calc. | 63.5 | 6.9 | 6.7 | 13.6 | 3.1 | 201–203 | Invention | A-1/Q-1 |
| | | found | 63.8 | 6.7 | 6.5 | 13.3 | 3.2 | | | |
| M-2 | 93.5 | calc. | 64.9 | 7.3 | 6.3 | 12.8 | 2.9 | 72–85 | Invention | A-1/Q-2 |
| | | found | 64.2 | 7.1 | 5.6 | 13.0 | 2.8 | | | |
| M-3 | 95.9 | calc. | 64.1 | 7.1 | 6.5 | 13.3 | 3.0 | 212–214 | Invention | A-1/Q-3 |
| | | found | 64.0 | 7.0 | 6.2 | 13.2 | 3.4 | | | |
| M-4 | 92.6 | calc. | 64.7 | 6.7 | 6.2 | 12.5 | 2.8 | 208 dec. | Invention | A-2/Q-1 |
| | | found | 62.7 | 6.3 | 5.9 | 11.8 | 2.9 | | | |
| M-5 | 99.1 | calc. | 65.9 | 7.1 | 5.8 | 11.8 | 2.7 | 72–85 | Invention | A-2/Q-2 |
| | | found | 65.4 | 7.0 | 5.3 | 11.9 | 2.6 | | | |
| M-6 | 90.7 | calc. | 65.2 | 6.9 | 6.0 | 12.2 | 2.8 | 206–208 | Invention | A-3/Q-1 |
| | | found | 63.2 | 6.5 | 5.4 | 11.8 | 3.2 | | | |
| M-7 | 89.3 | calc. | 66.4 | 7.3 | 5.7 | 11.5 | 2.6 | 72–85 | Invention | A-3/Q-2 |
| | | found | 65.1 | 7.0 | 5.3 | 11.5 | 3.2 | | | |
| M-8 | 84.6 | calc. | 65.7 | 7.0 | 5.9 | 11.9 | 2.7 | 197 dec. | Invention | A-3/Q-3 |
| | | found | 63.8 | 6.7 | 5.2 | 11.6 | 2.8 | | | |
| M-9 | na[d] | calc. | na | | | | | na | Invention | A-4/Q-1 |
| | | found | | | | | | | | |
| M-10 | 85.1 | calc. | na | | | | | glass | Invention | A-5/Q-1 |
| | | found | | | | | | | | |
| M-11 | na | calc. | na | | | | | na | Invention | A-6/Q-1 |
| | | found | | | | | | | | |

[a]All new couplers exhibited satisfactory $^1$H NMR (FT-300 MHz).
[b]Couplers were homogeneous in solvent systems of different polarity.
[c]The values represent minimum since some decomposition is observed with some couplers on HPLC although other analytical tools indicate them to be >95% pure.
[d]This information is not available.

Typically, the coupler is incorporated in a silver halide emulsion and the emulsion coated on a support to form part of a photographic element. Alternatively, the coupler can be incorporated at a location adjacent to the silver halide emulsion where, during development, the coupler will be in reactive association with development products such as oxidized color developing agent. Thus, as used herein, the term "associated therewith" signifies that the coupler is in the silver halide emulsion layer or in an adjacent location where, during processing, the coupler is capable of reacting with silver halide development products.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylene diamines. Especially preferred are:

4-amino N,N-diethylaniline hydrochloride,
4-amino-3-methyl-N,N-diethylaniline hydrochloride,
4-amino-3-methyl-N-ethyl-N-(β-(methanesulfonamido)ethyl)aniline sesquisulfate hydrate,
4-amino-3-methyl-N-ethyl-N-(α-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative working silver halide a negative image can be formed. Optionally positive (or reversal) image can be formed.

The magenta couplers described herein may be used in combination with other classes of magenta image couplers such as 3-acylamino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. No. 4,301,235; U.S. Pat. No. 4,853,319 and U.S. Pat. No. 4,351,897. The coupler may also be used in association with yellow or cyan colored couplers (e.g. to adjust levels of interlayer correction) and with masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The couplers may also be used in association with materials that accelerate or otherwise modify the processing steps e.g. of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is use of the coupler in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The couplers may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The coupler may further be used in combination with image-modifying compounds such as "Developer Inhibitor-Releasing" compounds (DIR's). DIR's useful in conjunction with the couplers of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

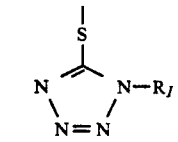

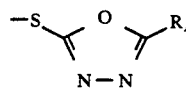

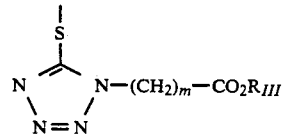

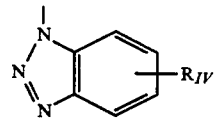

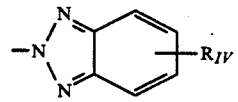

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and $-SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $—COOR_V$ and $—NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

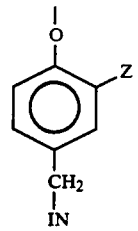

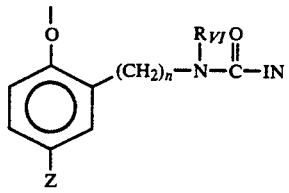

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

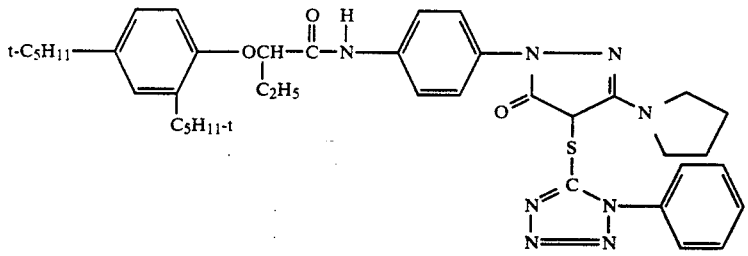

D2

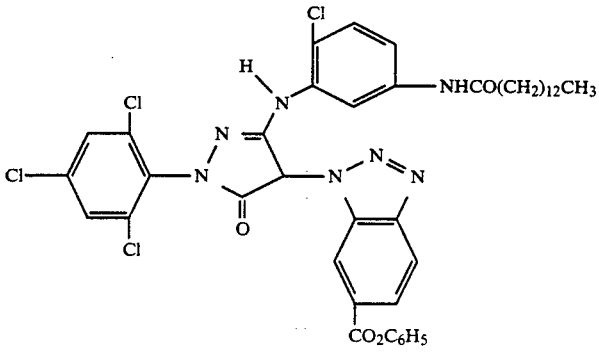

-continued
D3
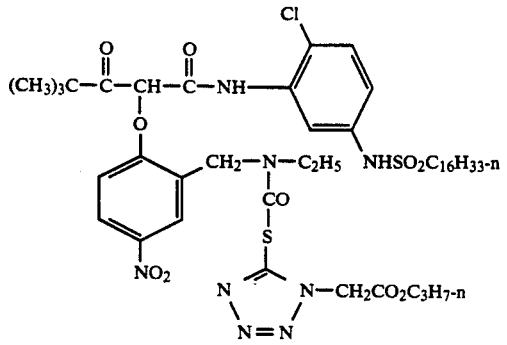
D4
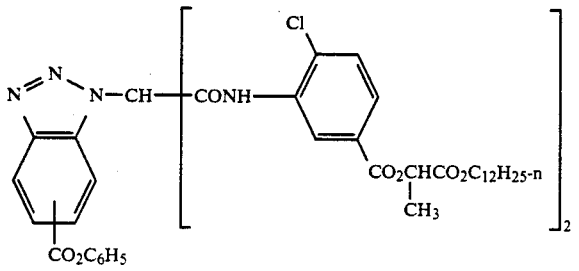
D5
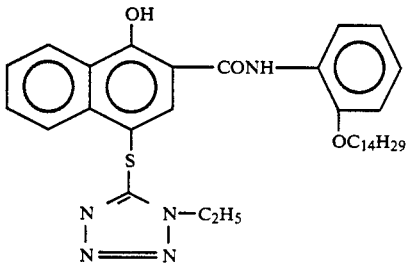
D6
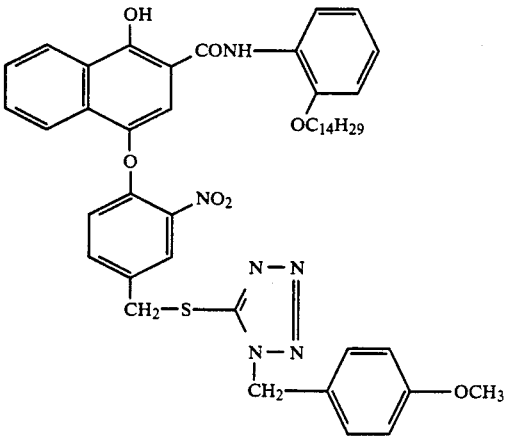

-continued

D7

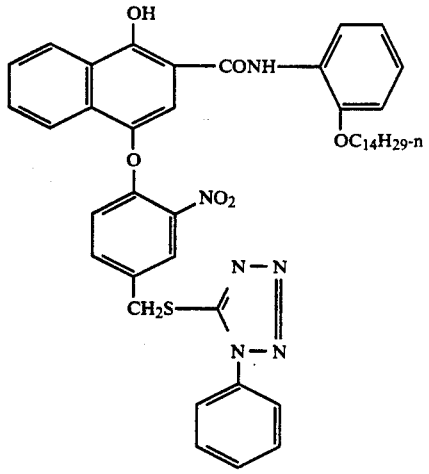

D8

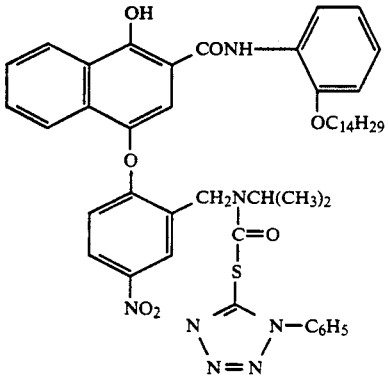

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961; with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

It is also contemplated that materials of the invention may be employed in conjunction with a photographic material where a relatively transparent film containing magnetic particles is incorporated into the material. The materials of this invention function well in such a combination and give excellent photographic results. Examples of such magnetic films are well known and are described for example in U.S. Pat. No. 4,990,276 and EP 459,349 which are incorporated herein by reference.

As disclosed in these publications, the particles can be of any type available such as ferro- and ferri-magnetic oxides, complex oxides with other metals, ferrites etc. and can assume known particulate shapes and sizes, may contain dopants, and may exhibit the pH values known in the art. The particles may be shell coated and may be applied over the range of typical laydown. The embodiment is not limited with respect to binders, hardeners, antistatic agents, dispersing agents, plasticizers, lubricants and other known additives.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T = ECD/t^2$$

where

ECD is the average equivalent circular diameter of the tabular grains in μm and t is the average thickness in μm of the tabular grains.

The average useful ECD of photographic emulsions can range up to about 10 μm, although in practice emulsion ECD's seldom exceed about 4 μm. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 μm) tabular grains. To achieve the lowest levels of granularity it is preferred to that aim tabular grain projected areas be satisfied with ultrathin (t<0.06 μm) tabular grains. Tabular grain thickness typically range down to about 0.02 μm. However, still lower tabular grain thicknesses are contemplated. For example, Daubendiek et al. U.S. Pat. No. 4,672,027 reports a 3 mole percent iodide tabular grain silver bromoiodide emulsion having a grain thickness of 0.017 μm.

As noted above the tabular grain of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventionaal teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The coupler solvents employed may be any of those know in the art, e.g. as described in Section XIV of the Research Disclosure.

The following examples are included for a further understanding of the invention.

COATING METHOD 1

Photographic elements were prepared by coating a gel-subbed, polyethylene-coated paper support with a photosensitive layer containing a silver chloride emulsion at 0.182 g Ag/m$^2$ for 2-equivalent couplers and 0.278 for the 4-equivalent coupler check. The levels of silver and coupler were chosen to provide approximately equal dye density for the couplers. Gelatin was coated at 1.64 g/m$^2$. The magenta image coupler (M-1) was coated at 0.334 mmol/m$^2$. The 2-equivalent check couplers C-3 and C-8 were coated at 0.423 mmol/m$^2$ while the 4-equivalent check coupler (C-1) was coated at 0.549 mmol/m$^2$. The invention and comparison 2-equivalent couplers were dispersed with the following addenda (weight percent of coupler): tricresyl phosphate (51.0%), Addendum-2 (10.3%), Addendum-3 (111.5%), Addendum-5 (60.2%). Comparison coupler C-1 was dispersed with the following addenda (weight percent of coupler): o-dibutyl phthalate (50%), Addendum-1 (42.6%), Addendum-2 (10%). The photosensitive layer was overcoated with a protective layer containing gelatin at 1.07 g/m$^2$ and bisvinylsulfonylmethyl ether hardener at 1.78 weight percent based on total gelatin.

COATING METHOD 2

Photographic elements were prepared by coating a gel-subbed, polyethylene-coated paper support with a photosensitive layer containing a silver chloride emulsion at 0.172 g Ag/m$^2$ (or 0.2865 for 4-equivalent couplers), gelatin at 1.238 g/m$^2$, and a magenta image coupler indicated below at 0.38 mmol/m$^2$ dispersed in an equal weight of tricresyl phosphate. Each coupler dispersion also contained the following addenda (weight percent of coupler): Addendum-3 (48%), Addendum-4 (29%), Addendum-5 (32%), Addendum-6 (16%), and ethyl acetate layer containing gelatin at 1.08 g/m$^2$ and bisvinylsulfonylmethyl ether hardener at 2 weight percent based on total gelatin.

Addendum-1:

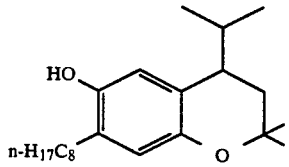

Addendum-2:

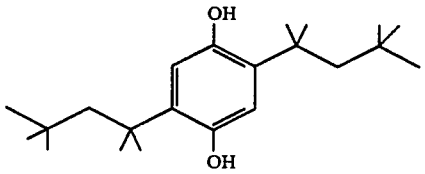

Addendum-3:

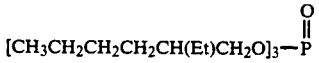

Addendum-4:

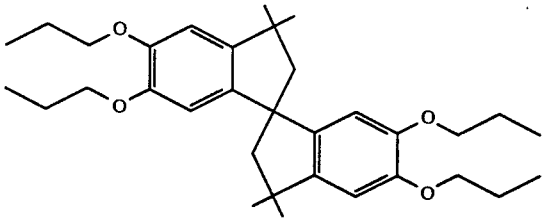

Addendum-5:

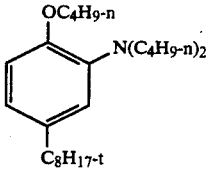

Addendum-6:

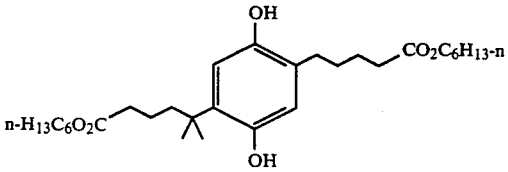

Samples of each element were imagewise exposed for 1/10 of a second through a graduated-density test object, then processed in color developer at 35° C. (45 seconds in a color developer 1, 45 seconds in the bleach-fix bath 1) washed and dried (Examples 1-3).

| | |
|---|---|
| Color Developer 1 (pH 9.98) | |
| Triethanolamine | 8.69 g |
| Stilbene whitening agent | 2.10 g |
| Lithium polystyrene sulfonate | 0.23 g |
| N,N-Diethylhydroxylamine (85% solution) | 5.04 g |
| Lithium sulfate | 1.83 g |
| 4-Amino-3-methyl-N-ethyl-N-(β-methanesulfonamido)ethylanilinsulfate hydrate | 5.17 g |
| 1-Hydroxyethylidene-1,1-di-phosphonic acid (60%) | 0.81 g |
| Potassium carbonate (anhydrous) | 20.00 g |
| Potassium bicarbonate | 3.59 g |
| Potassium chloride | 1.60 g |
| Potassium bromide | 10.0 mg |
| Potassium sulfite | 0.24 g |
| Water to make | 1.0 L |
| Color Developer 2 (pH 10.04) | |
| Triethanolamine | 12.41 g |
| Lithium sulfate | 2.70 g |
| N,N-Diethylhydroxylamine (85% solution) | 5.40 g |
| 1-Hydroxyethylidene-1,1-di-phosphonic acid (60%) | 1.16 g |
| 4-Amino-methyl-3-N-ethyl-N-(β-methanesulfonamido) ethylanilinsulfate hydrate | 5.00 g |
| Potassium carbonate (anhydrous) | 21.16 g |
| Potassium bicarbonate | 2.79 g |
| Potassium chloride | 1.60 g |
| Potassium bromide | 7.0 mg |
| Stilbene whitening agent | 2.30 g |
| Surfactant | 1 mL |
| Water to make | 1.0 L |
| Bleach-Fix Bath 1 (pH 5.5) | |
| Ammonium thiosulfate | 127.4 g |
| Sodium metabisulfite | 10.0 g |
| Ferric ammonium ethylenediamine tetraacetic acid (EDTA, 1.56M, pH 7.04, 44% wt.) (contains 10% molar excess EDTA, 3.5%) | 110.4 g |
| Glacial Acetic Acid | 10.2 g |
| Water to make | 1.0 L |
| Bleach-Fix Bath 2 (pH 6.8) | |
| Ammonium thiosulfate | 104 g |
| Sodium hydrogen sulfite | 13 g |
| Ferric ammonium ethylenediamine tetraacetic acid (EDTA) | 66.5 g |
| EDTA | 6.56 g |
| Ammonium hydroxide (28%) | 27.9 mL |
| Water to make | 1 L |
| Developer Retention Test Solution (pH 6.5 to 7.0) | |
| Potassium ferricyanide | 50.0 g |
| Sodium bromide | 17.0 g |
| Water to make | 1.0 L |

COATING METHOD 3

Single layer photographic elements were prepared by coating a cellulose acetate-butyrate film support (with a rem-jet antihalation backing) with a photosensitive layer containing a silver bromoiodide emulsion at 1.08 g/m$^2$, gelatin at 3.77 g/m$^2$ and an image coupler dispersed in the coupler/addenda as indicated at 0.52 mmoles/m$^2$. The photosensitive layer was overcoated with a layer containing gelating at 2.69 g/m$^2$ and bis-vinylsulfonyl methy ether hardener at 1.75 weight percent based on total gel.

Samples of each element were exposed imagewise through a stepped density test object and subjected to variants of the KODAK FLEXICOLOR (C41) process as described in *British Journal of Photography Annual* 1988, pp. 196-198.

In order to determine the level of non-imagewise stain formation (also referred to as continued coupling), comparisons were made between a set of examples that were processed with a 3% acetic acid stop bath for 1 minute between the development and bleach steps (no continued coupling), a set of examples processed without a stop bath ("normal" C41 conditions) and a set of examples processed without a stop bath and with the pH of the FLEXICOLOR bleach adjusted to 6.0 ("normal" bleach pH is 5.25). This last variation was intended to stimulate behavior in a "seasoned" bleach with increased pH due to carryover of high pH developer solution into the bleach. The difference in density at Dmin between the processed without stop and with stop reflects the level of continued coupling with larger values implying increased continued coupling.

Hue measurements were taken at an overall green density close to 1.0. An increase in the ratio of density at 440 and/or 480 nm (region of maximum blue sensitivity of color photographic paper) to 550 nm (region of maximum green sensitivity of color photographic paper) implies an undesirable hyposochromic shift in hue as detected by color photographic paper.

EXAMPLE 1

Dye images of processed strips (coating method 1, color developer 1, bleach-fix 1) were subjected to two-week 50 Klux xenon exposure through glass at 24° C. and 45% relative humidity. This test measures the stability of the image dye as a result of bright light exposure. The results of the dye density losses from a starting density of 1.0 are shown in Table II.

TABLE II

| | Dye Light Stability | |
|---|---|---|
| Coupler | Type | Density Loss |
| C-1 | Check | −0.32 |
| C-3 | Check | −0.29 |
| M-1 | Invention | −0.19 |

It can be seen from the data that the dye formed with the invention coupler has less light fade than the comparison couplers. In particular, a coupler employing the same type "COUP" but no "COG" (C-1) and one employing the identical "COUP" with an arylthio "COG" but without the substituted phenoxy or chiral group (C-3) exhibits a density loss far greater than the invention coupler (M-1).

EXAMPLE 2

Dye images of processed strips (coating method 1, color developer 1, bleach-fix 1) were subjected to high temperature (85° C.) dark keeping tests at 40% relative humidity for two weeks. The results of this accelerated test measure how well the images of the exposed and processed film holds up under dark storage conditions. The results are shown in Table III.

TABLE III

| | | Dark Stability | | |
|---|---|---|---|---|
| Coupler | Type | Fade from 1.0 | Density Gain (Blue Dmin) | Density Gain (Green Dmin) |
| C-1 | Check | −0.16 | +0.18 | +0.05 |
| C-3 | Check | −0.03 | +0.15 | +0.10 |
| M-1 | Invention | +0.02 | +0.07 | +0.03 |

These results show that the invention has significantly less dye density loss than the 4-equivalent check coupler (C-1) (same type "COUP," no "COG") and is also somewhat more stable than check coupler C-3. The small gain of the invention coupler may be due to an increased covering power phenomenon which may be present in the comparisons but is offset more in the comparisons than for the invention. Further, the invention coupler shows less changes in unexposed (minimum density) areas of the photographic coatings upon incubation than the comparison couplers.

EXAMPLE 3

The coatings (coating method 1) were tested in an altered process to monitor their propensity to retain color developing agent. The strips were processed as described before (color developer 1, beach-fix 1), but bleach-fix time was shortened to 15 seconds and the wash time was shortened from 2 minutes to 1 minute. The altered process times better simulate the occurrence of color developing agent retention in a seasoned process. After the altered process, the green density of the unexposed region of the coating was recorded. The coatings then were imbibed in the oxidizing solution for 90 seconds to oxidize any color developing agent which might have been retained and which eventually would have produced unwanted additional dye subsequent to the development process. After washing, the green density of the unexposed region of the strips was recorded again. The differences in green density before and after imbibition are shown in Table IV.

TABLE IV

| Retained Developer Test | | |
|---|---|---|
| Coupler | Type | Dmin Increase |
| C-1 | Check | 0.006 |
| C-3 | Check | 0.021 |
| M-1 | Invention | 0.001 |

At the level of coupler needed to give equivalent photographic results, the invention coupler shows much less Dmin density increase in comparison to check coupler C-3 and in comparison to 4-equivalent coupler C-1.

For examples 4–7, samples of each element were imagewise exposed for 1/10 of a second through a graduated-density test object, then processed in color developer at 35° C. (45 seconds in a color developer 2, 45 seconds in the bleach-fix bath 2) washed and dried.

EXAMPLE 4[a,b]

Comparison 4-equivalent coupler C-1 was coated by method 1 while comparison coupler C-3 and couplers of the invention were coated by method 2. Processed strips were kept under the conditions detailed below.

TABLE V

| Dark Stability - Unwanted Blue Density Gain | | | |
|---|---|---|---|
| Coupler | Type | Dry Oven (Δ Blue Dmin) | Wet Oven (Δ Blue Dmin) |
| C-1 | Check | 0.11 | 0.23 |
| C-3 | Check | 0.16 | 0.05 |
| M-1 | Invention | 0.07 | 0.02 |
| M-2 | Invention | 0.08 | 0.05 |
| M-3 | Invention | 0.07 | 0.01 |
| M-4 | Invention | 0.08 | 0.02 |
| M-5 | Invention | 0.11 | 0.02 |
| M-6 | Invention | 0.08 | 0.01 |
| M-7 | Invention | 0.13 | 0.04 |

[a]Dry Oven Conditions: 4 weeks at 77° C./15% relative humidity.
[a]Wet Oven Conditions: 4 weeks at 60° C./70% relative humidity.

This is an accelerated test to show the dark stability of the couplers as measured by increase in yellow stain where there is no exposure. The change of blue density in the dry oven test is consistently equal or better for the invention couplers than for comparison couplers C-1 and C-3. In the wet oven test, the invention couplers show much less change than comparison 4-equivalent coupler C-1. (Note that a 0.005 difference is typically discernible in side by side viewing to the person with average eyesight).

EXAMPLE 5

Comparison coupler C-4 and couplers of the invention were coated by method 2. Processed strips were kept under the conditions detailed below.

TABLE VI

| Dye Light Stability | | |
|---|---|---|
| Coupler | Type | Density Loss (Δ from 1.0) |
| C-4 | Check | −0.53 |
| M-4 | Invention | −0.42 |
| M-5 | Invention | −0.35 |

[a]Light Fade Conditions: 4 weeks at 50 Klux xenon exposure through glass at 24° C. and 45% relative humidity.

The couplers of the invention produce dyes which are more resistant to light induced fade than comparison coupler C-4.

EXAMPLE 6

The invention couplers and comparison coupler C-2 were coated using method 2 and processed using method 2. The processed coatings were exposed to heat and the results are tabulated below.

TABLE VII

| Undesired Stable Leuco-dye Formation | | | |
|---|---|---|---|
| Coupler | Type | Dry Oven (Δ from 1.7) | Wet Oven (Δ from 1.7) |
| C-2 | Check | 0.23 | 0.26 |
| M-1 | Invention | 0.04 | 0.07 |

[a]Dry Oven Conditions: 1 week at 77° C./15% relative humidity.
[a]Wet Oven Conditions: 1 week at 60° C./70% relative humidity.

The large increases in density for the check coupler indicate that a stable leuco-dye was present and formed additional magenta dye upon heat treatment. Such a condition is unacceptable since the color balance of the developed image will be unstable. The couplers of the invention do not form a stable leuco-dye under these rapid (90 sec) access conditions. Therefore, couplers of the invention do not require Lippman fine grain silver halide for rapid machine processing, a distinct advantage over comparison coupler C-1.

EXAMPLE 7

The invention couplers and comparison coupler C-5 were coated using method 2 and processed using method 2. The processed coatings were exposed to heat and the results are tabulated below.

TABLE VIII

| Maximum Density of the Magenta Dye | | |
|---|---|---|
| Coupler | Type | Dmax |
| C-5 | Check | 0.70 |
| M-6 | Invention | 2.61 |

As is seen in the table, the check coupler does not form an acceptable amount of dye density, and is therefore not useful.

EXAMPLE 8

The invention couplers and the comparison couplers indicated were coated and processed using method 3. The dye hue curves were measured and the ratios of the density at 440 nm and 480 nm versus the density at 550 nm is shown in Table IX.

TABLE IX

| Dye Hue for Optimum Color Reproduction in Positive-Negative Systems | | | |
|---|---|---|---|
| Coupler | Type | $D_{440}/D_{550}$ | $D_{480}/D_{550}$ |
| C-2 | Check | 0.151 | 0.324 |
| C-3 | Check | 0.138 | 0.305 |
| C-4 | Check | 0.150 | 0.326 |
| C-6 | Check | 0.131 | 0.310 |
| C-7 | Check | 0.144 | 0.320 |
| M-1 | Invention | 0.135 | 0.300 |
| M-9 | Invention | 0.086 | 0.269 |

For best color reproduction, the ratio of blue density at 440 nm and 480 nm to green density at 550 nm should be as low as possible. As the data in the table indicates, couplers of the invention have less unwanted blue absorption, relative to check couplers.

EXAMPLE 9

The light stability and coupler efficiency to obtain equivalent sensitometry were compared for known and invention couplers. The comparison and invention couplers were coated by Method 1. The samples were subjected to 24 week 5.4 Klux exposure and the dye light fade (as measured by green density loss) and unwanted density gain (as measured by blue Dmin gain) were recorded. Also, the amount of coupler laydown to obtain equivalent sensitometry was recorded. This is a measure of the efficiency of dye formation for a coupler.

The results are shown in Table X. This comparison demonstrates that the coupler of the invention is the most efficient while providing consistent light stability results compared to other individual comparison couplers. Especially noteworthy is the reduction in unwanted blue density gain.

TABLE X

| Light Stability/Coupler Efficiency | | | | | |
|---|---|---|---|---|---|
| | | Light Stability | | Coupler Efficiency | |
| Coupler | Type | Density Loss (From 1.0) | Density Gain (Blue Dmin) | Equiv. Coupler mmol/m² | Equiv Coupler vs Invention |
| C-1 | Check | −.47 | +.30 | .549 | +64.3% |
| C-3 | Check | −.30 | +.10 | .423 | +26.6% |
| C-8 | Check | −.18 | +.09 | .423 | +26.6% |
| M-1 | Invention | −.30 | +.06 | .334 | 0 |

EXAMPLE 10

This Example measures the degree of undesired "continued coupling" obtained with the invention relative to the comparison. Continued coupling results when developer is carried over in the bulk sense into the bleach bath (as happens in a seasoned bath during processing). The developer is oxidized by the bleach to form oxidized developer (Dox). If the Coupler is readily ionized in the bleach bath, then it will react with the Dox to form non-imagewise dye or stain. Table XI shows the results. Samples were coated by method 3. The comparison demonstrates that when an arylthio coupling-off group containing an unsubstituted phenoxy substituent is employed, the extent of continued coupling is undesirably increased. When using different coupler solvent systems, increases of continued coupling compared to the invention ranging from 1% to 46% were observed.

TABLE XI

| Continued Coupling | | | |
|---|---|---|---|
| | | Continued Coupling | |
| Coupler | Type | Increased Dmin in pH6 Bleach | % Increase Over Invention |
| C-6 | Check | .202 | 7.4% |
| M-1 | Invention | .188 | 0 |

The invention has been described in detail with particular reference to preferred embodiments thereof, but it will be understood that variations and modifications can be effected within the spirit and scope of the invention.

What is claimed is:

1. A photographic element comprising a support bearing at least one silver halide emulsion layer having associated therewith a 5-pyrazolone photographic coupler represented by the following formula:

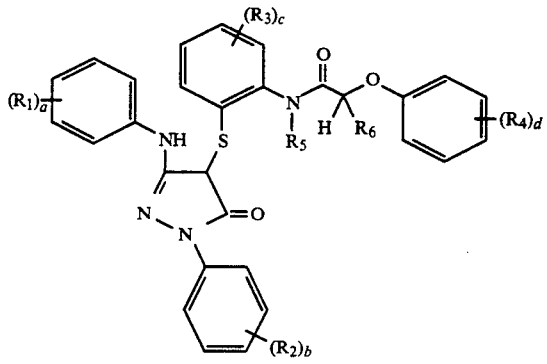

wherein a and b are individually 0 to 5, c is 0 to 4, and d is 1 to 5;

each $R_1$, $R_2$, $R_3$ and $R_4$ is individually selected from the group consisting of hydrogen, halogen, nitro, cyano, carboxy, alkyl, aryl, alkoxy, aryloxy, acylamino, sulfonamido, sulfamoyl, sulfamido, carbamoyl, diacylamino, aryloxycarbonyl, alkoxycarbonyl, alkoxysulfonyl, aryloxysulfonyl, alkylsulfonyl, arylsulfonyl, alkylsulfoxyl, arylsulfoxyl, alkylthio, arylthio, alkoxycarbonylamino, alkylureido, arylureido, heterocyclic, and acyloxy;

$R_5$ is selected from the group consisting of hydrogen, alkyl, aryl, acyl and heterocyclic group; and $R_6$ is selected from the group consisting of hydrogen, alkyl, aryl, and heterocyclic group.

2. The element of claim 1 wherein $R_5$ is hydrogen.

3. The element of claim 1 wherein b is 1 to 5, and at least one $R_2$ is halogen.

4. The element of claim 3 wherein b is 3 to 5, and at least three $R_2$ are chlorine.

5. The element of claim 1 wherein a is 1 to 5, and the sum of the carbon atoms of the substituents $R_1$ is at least 8.

6. The element of claim 1 wherein a is 1 to 5, and at least one $R_1$ is halogen.

7. The element of claim 6 wherein said halogen is chlorine.

8. The element of claim 1 wherein a is 1 to 5, and at least one $R_1$ is —NRCOR; —$SO_2NR_2$; —$NRSO_2R$; —$CONR_2$; —$CO_2R$; or —$SO_2R$; where each R is individually selected from hydrogen, alkyl, aryl and heterocyclic.

9. The element of claim 8 wherein at least one $R_1$ is —NRCOR.

10. The element of claim 1 wherein the carbon to which $R_6$ is attached is the center of a chiralic group.

11. The element of claim 1 wherein at least one $R_4$ is an alkyl group.

12. The element of claim 11 wherein said $R_4$ alkyl group has at least 4 carbon atoms.

13. The element of claim 12 wherein the sum of the carbon atoms in $R_3$, $R_4$, $R_5$ and $R_6$ is at least 8.

14. The element of claim 1 additionally comprising a layer containing magnetic particles.

15. A process for developing a photographic element comprising contacting an element as defined in claim 1 with a color developing agent.

* * * * *